US007207361B1

(12) United States Patent
Vice

(10) Patent No.: US 7,207,361 B1
(45) Date of Patent: Apr. 24, 2007

(54) ROUTER GUIDE BUSHING

(76) Inventor: James Perry Vice, 288 Boeing Ct., Livermore, CA (US) 94551

( * ) Notice: Subject to any disclaimer, the term of this patent is extended or adjusted under 35 U.S.C. 154(b) by 165 days.

(21) Appl. No.: 10/896,295

(22) Filed: Jul. 20, 2004

(51) Int. Cl.
*B27C 5/10* (2006.01)

(52) U.S. Cl. ..... 144/136.95; 144/154.5; 409/182

(58) Field of Classification Search ..... 144/136.1, 144/136.95, 154.5, 145.3; 409/110, 125, 409/130, 182; 33/197, 562, 567
See application file for complete search history.

(56) References Cited

U.S. PATENT DOCUMENTS 3,332,462 A * 7/1967 Williams ..... 144/251.1
5,584,328 A * 12/1996 Grisley ..... 144/145.3
6,736,173 B1 * 5/2004 Grisley et al. ..... 144/145.3

* cited by examiner

*Primary Examiner*—Shelley Self
(74) *Attorney, Agent, or Firm*—Risto A. Rinne, Jr.

(57) ABSTRACT

An apparatus for use with a router that is adapted to secure a guide bushing to a base of the router includes a modified retaining nut that includes a plurality of extensions that extend radially away from the nut. Each extension includes a threaded hole that is adapted to receive a set screw. The retaining nut includes interior screw threads that cooperate with outside screw threads of the guide bushing. The guide bushing is disposed on one side of a hole provided in the base of the router and the retaining nut is lightly tightened secure the guide bushing in a recess provided in the router base. The set screws are then tightened and bear against the router base sufficient to urge the retaining nut away from the guide bushing thereby placing the screw thread of both under tension, while simultaneously engaging with the router base sufficient to retain the retaining nut in position relative to the router base.

5 Claims, 1 Drawing Sheet

ROUTER GUIDE BUSHING

BACKGROUND OF THE INVENTION

1. Field of the Invention

The present invention, in general relates to accessories for woodworking tools and, more particularly, to a guide bushing for use with a router.

Routers are well known types of devices used in the woodworking arts to cut dados, various shaped edges and corners, and other specialty types of cuts.

Routers are often used in conjunction with other types of accessory equipment to align them as desired to a work piece, for example. A common device for use with a router is called a "guide bushing".

The guide bushing secures to the router base, proximate the cutting "bit". The guide bushing allows for better control or securing of the router.

A typical guide bushing includes a known outside diameter. Accordingly, other accessory equipment items include a channel into which the guide bushing snugly fits. The router is then moved in the channel and its motion is thus controlled.

Alternatively, the accessory equipment includes an area into which the guide bushing fits. Perhaps some aspect of the accessory equipment is moved or the work piece is moved relative to the accessory equipment. In either situation, the action of the router is well controlled.

However, there exists a problem with guide bushings and that is a tendency for the bushing to loosen. Routers operate at high RPM and the vibration tends to loosen the guide bushings.

There is no known way to secure a guide bushing on a router. Set screws pass through a cylinder typically. They include a longitudinal axis that is perpendicular with a longitudinal axis of the cylinder that they pass through so that when tightened they can bear on another object that is concentrically disposed either inside or outside the cylinder.

The use of a set screw to bear against the threaded portion is not possible for two reasons. The first is that it is undesirable to mar the threads into which the guide bushing cooperates because this would make it difficult, or impossible, to later remove the bushing when it is not needed or to install one of a different outside diameter.

The second reason is it is not possible to access a set perpendicular screw in such a tight area. There are certain types of smaller routers that are commonly known as "trim routers", with which it is presently impossible to even nominally tighten a conventional type of a guide bushing because the available area in a recess in the router base that is disposed around the guide bushing is so small, it is difficult to grab the bushing with any type of tool that could be used to tighten it.

While these problems occur with a variety of different types of routers, those manufactured by the company "PORTER CABLE" include a center hole in the base with a recessed portion that the instant invention is particularly applicable for use with.

When a guide bushing becomes loose, considerable damage can occur. First, because the router experiences greater tolerances between itself and the guide bushing, the router can move an increased amount relative to the work piece. This can cause the router to cut the work piece (i.e., the board) in an area that is not intended, possibly ruining the work piece.

If the guide bushing loosens entirely, the router bit can strike it, damaging the bit and the bushing, possibly even imparting energy to the bushing and propelling it as a missile.

Also, the router is no longer retained by the guide bushing and can move relative to the work piece in any direction. This is almost certain to cause damage to the work piece.

In general, the use of a guide bushing with a router is to be more precise with the positioning and movement of the router relative to the work piece. A loose or absent guide bushing is disastrous to this objective.

Accordingly, there exists today a need for a router guide bushing that helps ameliorate the above-mentioned difficulties.

Clearly, such an apparatus would be a useful and desirable device.

2. Description of Prior Art

Router guide bushings are, in general, known as shown in the PRIOR ART FIGURE. While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a router guide bushing that is easy to install on a router.

It is also an important object of the invention to provide a router guide bushing that is easy to remove from a router.

Another object of the invention is to provide a router guide bushing that resists loosening.

Still another object of the invention is to provide a router guide bushing that will not loosen during normal use when properly installed.

Still yet another object of the invention is to provide a router guide bushing that is adapted for use with existing types of router guide bushings.

Yet another important object of the invention is to provide a router guide bushing that can be used upside down to provide additional clearance for use with especially thick router bases.

Still yet another important object of the invention is to provide a router guide bushing that is adapted for use with PORTER CABLE brand types of routers.

A first continuing object of the invention is to provide a router guide bushing that includes at least one set screw that includes a longitudinal axis that is parallel with respect to a longitudinal axis of a bit of a router.

Briefly, a router guide bushing that is constructed in accordance with the principles of the present invention has a conventional type of guide bushing with a modified type of a nut. The nut includes at least one and preferably two extensions that protrude from an outside of the nut. Each extension is threaded to receive a set screw. Each set screw is oriented so as to include a longitudinal axis that is in line with a longitudinal axis of a router bit. The nut is threaded over the conventional guide bushing until it is finger tight. The set screws are then tightened which bear against a base of the router and urge the nut away from the guide bushing.

The guide bushing is retained by the base of the router. This causes a binding of the threads intermediate the nut and the guide bushing sufficient to retain the nut and guide bushing in place. Friction intermediate the set screws and the base of the router also retain the nut in position.

DETAILED DESCRIPTION OF THE INVENTION

Figure 1:
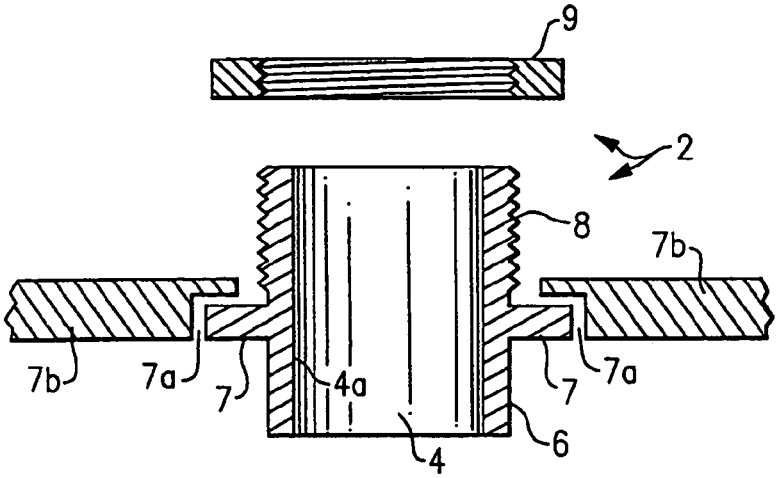
FIG.1 Prior Art
FIG. 1 is a cross-sectional view of a prior art type of guide bushing.

Referring to FIG. 1 is shown, a prior art type of a router guide bushing, identified in general by the reference numeral 2.

A conventional type of a guide bushing 4 includes a predetermined outside diameter 6 at a lower end thereof and a hollow longitudinal core 4*a*. The hollow core 4*a* is shown as having a constant inner diameter, however, the inner diameter of the hollow core 4*a* can vary along its longitudinal length, as desired.

The outside diameter 6 is held to close tolerances and is used in accessory types of equipment (not shown), for example, devices that assist in cutting dados in boards. Such devices include a channel that corresponds with the outside diameter 6 sufficient to receive the lower end in the channel and allow for motion of the guide bushing 4 along the longitudinal length of the channel but not perpendicular thereto.

Different types of guide bushings 4 include different outside diameters 6, as preferred.

The guide bushing 4 includes a flange 7 that extends from the guide bushing 4 and includes a larger outside diameter than the guide bushing 4.

The flange 7 fits into a recess 7*a* that is provided in a base 7*b* of a router (not shown).

A top of the guide bushing 4 includes outside threads 8 that extend above the base 7*b*. A knurled nut 9 cooperates with the threads 8 and is used to secure the guide bushing 4 to the base 7*b*. Nuts, other than knurled may also be used.

However, during vibration the nut 9 is prone to loosen sufficient to allow the guide bushing 4 to become dislodged out of the recess 7*a* where it can strike a bit (not shown). The bit is the cutting tool (well known) that is attached to a router shaft (not shown) that extends down through the hollow core 4*a* of the guide bushing 4.

Figure 2:
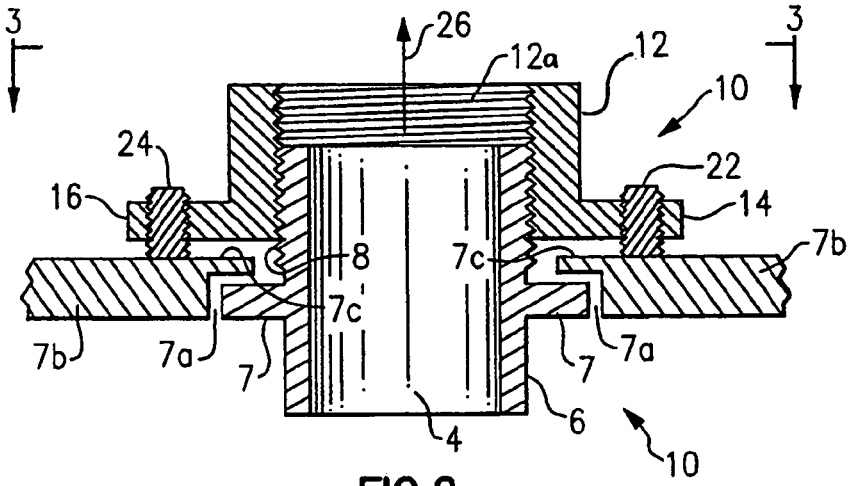
FIG. 2 is a cross-sectional view of the inventive router guide bushing.
Figure 3:
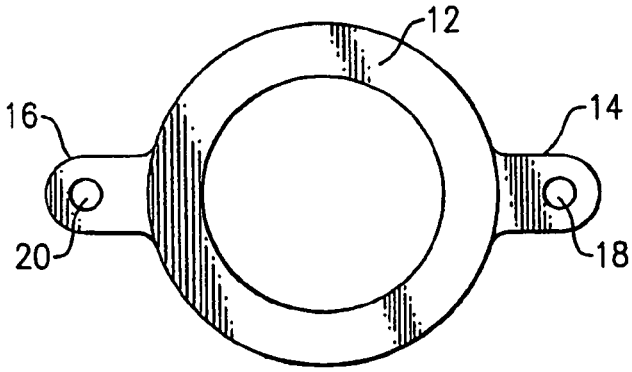
FIG. 3 is a view of a modified nut of FIG. 2 taken along the line 3—3 therein, absent a pair of set screws.

Referring to FIG. 2 and FIG. 3 is shown, a router guide bushing, identified in general by the reference numeral 10.

The router guide bushing 10 includes a modified type of retaining nut 12. The retaining nut 12 includes a pair of diametrically opposed extensions 14, 16 that extend from a bottom 12*a* of the retaining nut 12 away from a longitudinal center thereof. While any number of the extensions 14, 16 may be used, preferably an even number of extensions 14, 16 are included, where each of which being disposed on opposite sides of the retaining nut 12. This aids in the tightening of the router guide bushing 10, as is described in greater detail hereinafter.

Each extension 14, 16 includes a threaded hole 18, 20 that includes a longitudinal axis that aligns with the longitudinal axis of the retaining nut 12.

A pair of set screws 22, 24 cooperate with the threaded holes 18, 20.

In use, the set screws 22, 24 are retracted so that a bottom portion thereof does not protrude from a bottom of the extensions 14, 16 of the retaining nut 12.

The guide bushing 4 is then inserted up from the bottom of the router base 7*b* so that the flange 7 fits into the recess 7*a*.

The retaining nut 12 is then inserted from the top of the router base 7*b* until inside threads 12*a* contact the outside threads 8 of the bushing 4. The retaining nut 12 is then tightened finger tight. The amount of tightening of the retainer nut 12 relative to the router base 7*b* is not critical, unlike all previous designs.

Using an Allen wrench (not shown) or other conventional tightening type of tool (i.e., an offset type of a screw driver), each set screw 22, 24 is then alternately tightened so that a bottom of each set screw 22 first bears on the top of the router base 7*b*. Alternate tightening continues until sufficient torque has been applied to the set screws 22, 24 sufficient to urge the retaining nut 12 up and away from the router base 7*b* as shown by arrow 26.

This motion of the retaining nut 12 relative to the guide bushing 4 puts the outside threads 8 of the bushing 4 under tension with the inside threads 12*a* of the retaining nut 12, thereby increasing friction and securing the guide bushing 4 in position.

It also ensures that the guide bushing 4 is held tightly in the recess 7*a*, against a lip 7*c* of the router base 7*b*.

The bottoms of the set screws 22, 24 also bear against the top of the router base 7*b*, causing a binding to occur there as well. The bottoms of the set screws 22, 24 engage with the top of the router base 7*b* sufficient to prevent rotation of the retaining nut 12 relative to the router base 7*b* during vibration arising from when the router is running.

The tension between the threads 8 of the guide bushing 4 and those of the retaining nut 12 prevent the guide bushing 4 from similarly rotating during use of the router relative to the retaining nut 12.

Accordingly, neither retaining nut 12 nor guide bushing 4 can loosen during use.

Certain types of routers include an especially thick router base 7*b*. The retaining nut 12 includes a generally T-shaped cross section. As shown, the bottom of the "T" is disposed against the router base 7*b* for use with nominally thick or thinner types of the router base 7*b*.

If the router base 7*b* is especially thick, the retaining nut 12 is simply turned upside down and is engaged with the outside threads 8. The set screws 22, 24 are also removed from the threaded holes 18, 20 and are threaded therein from the opposite side.

Accordingly, the same procedure is used as described hereinabove, but with the retaining nut 12 upside down to accommodate thicker types of the router base 7*b*.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A router guide bushing for use with a router having a base, comprising:

(a) a guide bushing that includes a lower portion thereof with a predetermined outside diameter and a flange extending from an outside thereof and including outside threads at an end opposite said lower portion;

(b) a retaining nut that includes an extension that extends radially away from a longitudinal center of said retaining nut, and wherein said extension includes a threaded hole that is adapted to receive a set screw therein and wherein said retaining nut includes inside threads that are adapted to cooperate with said outside threads of said guide bushing sufficient to secure said guide bushing in position in said router base;

and wherein said set screw is adapted to cooperate with said router base sufficient to bear upon a surface of said router base sufficient to secure said retaining nut in position relative to said router base.

2. The router guide bushing of claim 1 wherein said set screw includes a longitudinal axis that is parallel with a longitudinal axis of said guide bushing.

3. The router guide bushing of claim 1 including a plurality of extensions.

4. The router guide bushing of claim 3 wherein each of said plurality of extensions is disposed radially around said retaining nut.

5. The router guide bushing of claim 4 wherein said plurality of extensions includes a pair of diametrically disposed extensions.

* * * * *